US006047141A

United States Patent [19]

Miyaoka et al.

[11] Patent Number: 6,047,141

[45] Date of Patent: Apr. 4, 2000

[54] IMAGE RECORDING APPARATUS

[75] Inventors: Mitsuhiko Miyaoka, Shiga; Hideaki Kawai, Kyoto, both of Japan

[73] Assignee: Murata Kikai Kabushiki Kaisha, Kyoto, Japan

[21] Appl. No.: 09/299,290

[22] Filed: Apr. 26, 1999

[30] Foreign Application Priority Data

May 1, 1998 [JP] Japan ..... 10-122253

[51] Int. Cl.[7] ..... G03G 15/08

[52] U.S. Cl. ..... 399/27; 399/99; 399/254

[58] Field of Search ..... 399/27, 30, 73, 399/74, 98, 99, 254

[56] References Cited

U.S. PATENT DOCUMENTS

| | | | |
|---|---|---|---|
| 4,959,690 | 9/1990 | Trainor et al. | 399/254 |
| 5,035,198 | 7/1991 | Niito | 399/27 |
| 5,036,363 | 7/1991 | Iida et al. | 399/30 |
| 5,499,077 | 3/1996 | Endo et al. | 399/27 |
| 5,612,770 | 3/1997 | Bandai et al. | 399/254 |
| 5,655,175 | 8/1997 | Oshida | 399/27 |
| 5,752,145 | 5/1998 | Nakaue et al. | 399/254 X |

FOREIGN PATENT DOCUMENTS 7-287447 10/1995 Japan .

*Primary Examiner*—Sandra Brase
*Attorney, Agent, or Firm*—Loeb & Loeb, LLP

[57] ABSTRACT

An image recording machine (8) having a remaining toner detection unit arranged inside a main body of a developer (41). Toner (40) is housed in the developer main body. The image recording machine (8) also includes a scraper (57) which cleans toner (40) out of a recess (56*a*) of the remaining toner detection unit as it is rotated integrally with an agitator. A supply member (47) for supplying stored toner (40) to the recess (56*a*) of the remaining toner detection unit rotates with the scraper (57) and is arranged at a 90° angle downstream from the scraper (57) relative to their direction of rotation. The supply member (47) is formed as a flexible member.

6 Claims, 6 Drawing Sheets

IMAGE RECORDING APPARATUS

BACKGROUND OF THE INVENTION

1. Field of the Invention

The present invention generally relates to an image recording apparatus employing an electro-photographic method, and more particularly to an image recording apparatus provided with a remaining toner detection unit arranged inside a developer main body, and with a scraper which cleans the remaining toner detection unit.

2. Description of the Related Art

In a conventional image recording apparatus that employs an electro-photographic method, a developer is provided with a remaining toner detection unit arranged inside the developer main body, allowing the device to detect whether or not there is any toner remaining. The remaining toner detection unit is provided with a transparent sensor cover having a recess or groove therein. A photo sensor is mounted in the concave recess of the sensor cover, allowing detection of the presence of toner in the developer main body by detecting whether or not there is any toner inside the concave recess.

However, since toner easily adheres to the walls of the recessed portion near the remaining toner detection unit, it is often difficult to reliably detect the presence of remaining toner. Thus, it is needed to keep the recess clean at all times.

In a conventional image recording apparatus, a scrapper is attached to a toner agitator arranged inside the developer main body, and a cleaning mechanism for cleaning the remaining toner detection unit is established by rotating both the scraper and agitator.

Such a cleaning mechanism, however, may incorrectly detect an absence of toner when in fact a small amount of toner remains in the developer main body unit if, for example, the remaining toner is not supplied to the recess after the recess is cleaned with the scraper.

SUMMARY OF THE INVENTION

It is thus an object of the present invention to provide an image recording apparatus which solves the above described problem of the developer.

According to one aspect of the present invention, there is provided an image recording apparatus having a remaining toner detection unit arranged within the main body of a developer unit in which toner is stored, and having a scraper which rotates to clean the remaining toner detection unit, characterized in that a supply member for supplying stored toner to the remaining toner detection unit is adapted to rotate with the scraper and arranged downstream of the scraper relative to their direction of rotation. Since the toner supply member is arranged downstream of the scraper relative to their direction of rotation, toner can be supplied by the supply member to the remaining toner detection unit after the remaining toner detection unit is cleaned even when there is only a small amount of toner remaining inside the developer main body. This enables accurate detection of the presence of toner or enables mistaken detection to be avoided.

The remaining toner detection unit may have a groove to receive the remaining toner, and the scraper may clean the groove.

The supply member may be arranged downstream of the scraper at roughly a 90° angle relative to the rotating direction of the scraper. The supply member located at this position can promptly feed the toner into the remaining toner detection unit (or the groove thereof) after the scraper has cleaned the remaining toner detection unit or while the scraper is cleaning the remaining toner detection unit. Therefore, the remaining toner detection is accurately performed. It should be noted, however, the location of the supply member is not limited to 90° down-stream position. For example, the supply member may be located about 60° or 150° downstream of the scraper. If the 150° down-stream position is adopted, however, there is a relatively long interval after the cleaning of the groove of the remaining toner detection unit until the toner feeding into the groove. If the remaining toner detection unit has a steeply inclined groove, it may be difficult to correctly detect the presence of the remaining toner when the amount of remaining toner is relatively small because the toner easily drops through the inclined groove. It is therefore preferred that the supply member supplies the toner into the groove of the remaining toner detection unit before the scraper passes the groove completely in a certain application.

The supply member may be formed as a flexible member. The flexible supply member can bend due to the weight of the toner if a large (or relatively large) amount of toner remains in the developer main body. This bending reduces the stress to be applied to the toner and therefore prevents deterioration of the toner. If the supply member were rigid, the toner would easily be degraded by friction between the toner particles themselves, and the stress applied to the toner. In particular, the toner deterioration would be promoted if a large amount of toner were agitated by the solid member.

DETAILED DESCRIPTION OF THE INVENTION

An embodiment of the present invention will now be described in reference to the accompanying drawings.

Figure 1:
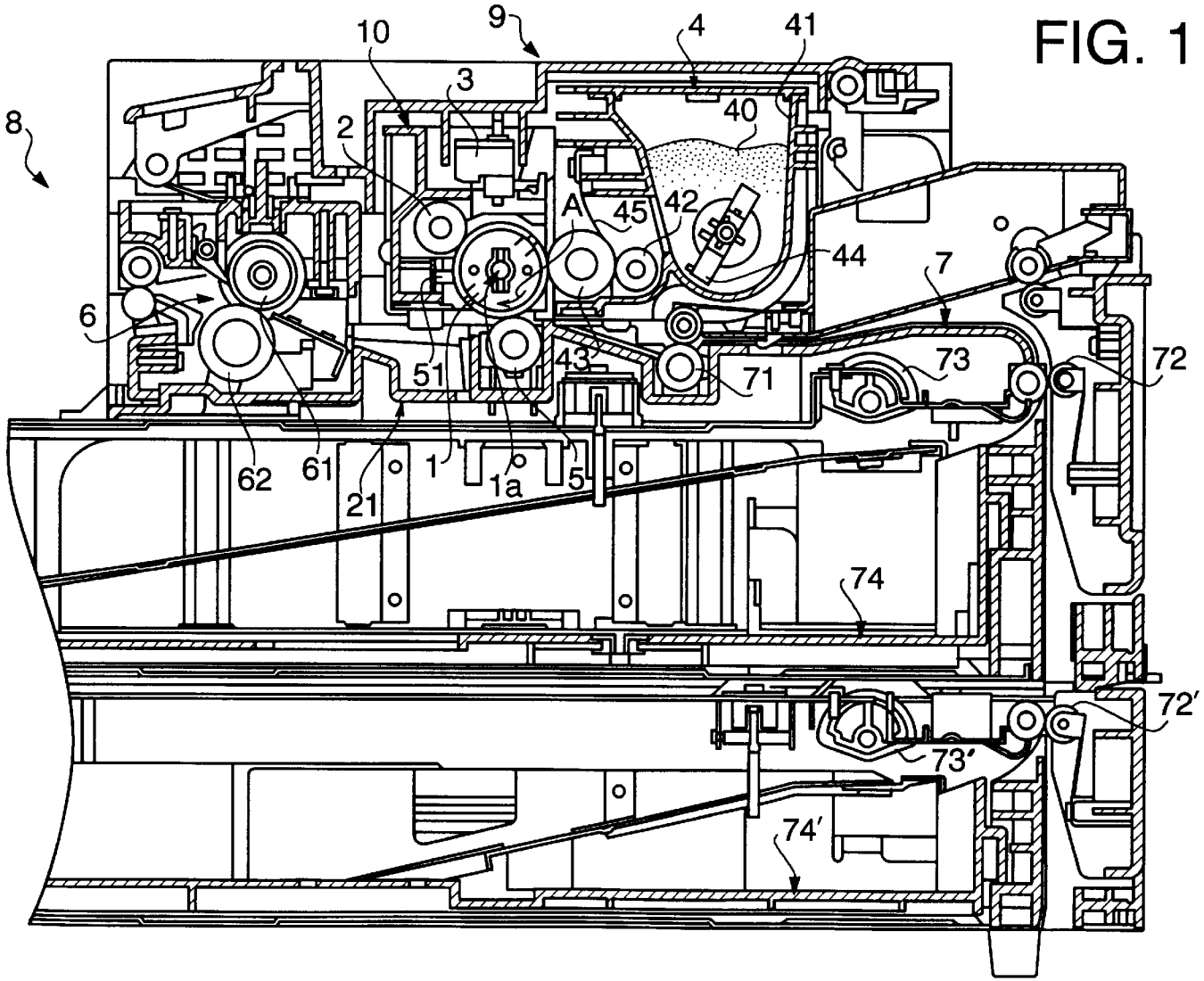
FIG. 1 is a side cross-sectional diagram showing the inside of an image recording apparatus according to the present invention.
Figure 2:
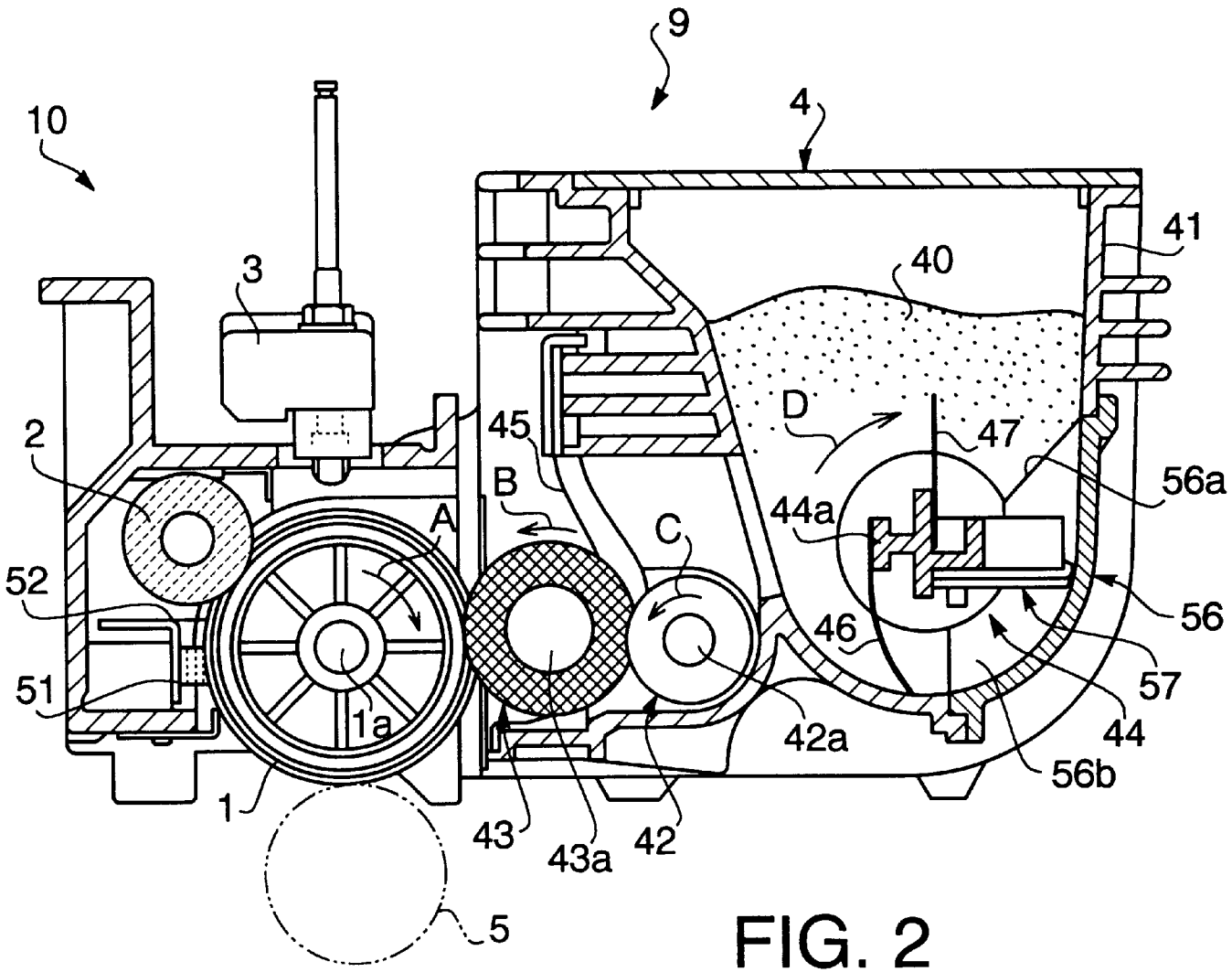
FIG. 2 is an enlarged side cross-sectional diagram showing a developer unit and a drum unit of the image recording apparatus shown in FIG. 1.
Figure 3:
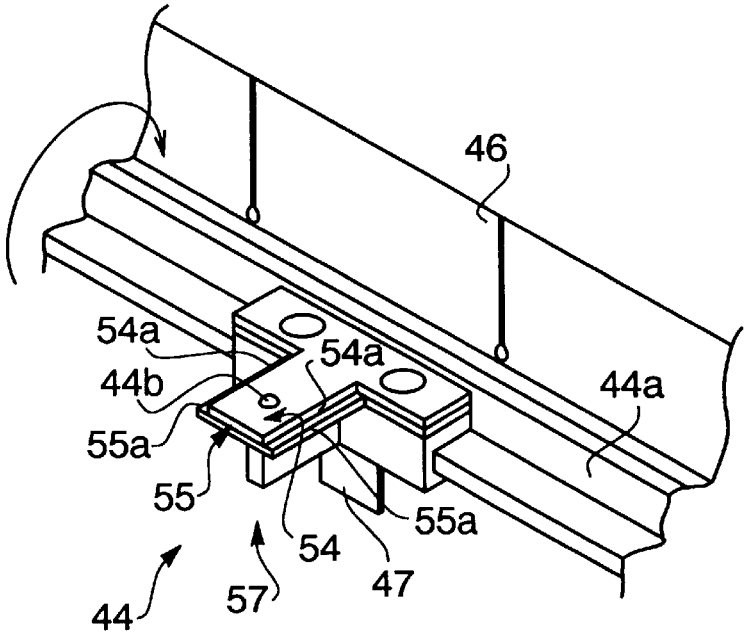
FIG. 3 is an enlarged perspective view diagram showing an agitator equipped with a scraper and a supply member incorporated in the image recording apparatus shown in FIG. 1.
Figure 4:
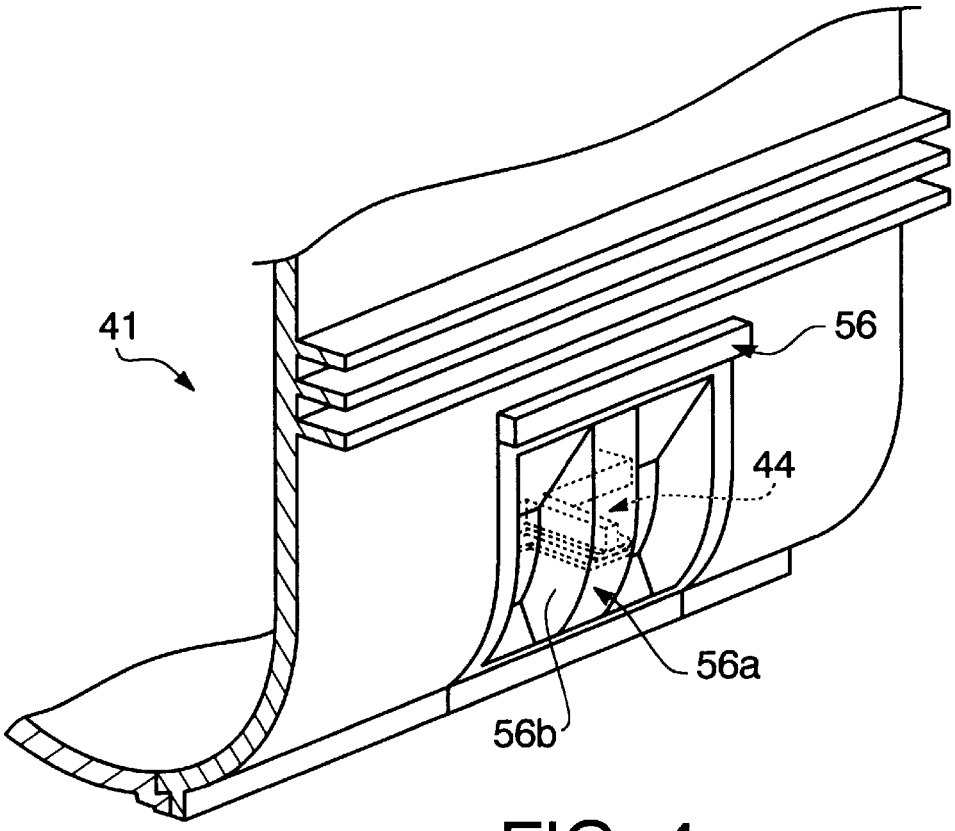
FIG. 4 is a perspective view diagram showing the recess formed in the developer main body.

Referring to FIGS. 1 and 2, an overview of the structure of an image recording apparatus 8 according to the present invention will be described. The image recording apparatus 8 may be, for example, an electro-photographic type image recording apparatus adapted for use in a facsimile machine or the like. A process unit 9 is arranged in the upper portion of the image recording apparatus 8, and includes a drum unit 10, a developer unit 4 and other components. A photosensitive drum 1 is located in the drum unit 10. A charger 2, a photo transcribing unit 3 (an LED head array), the developer unit 4, a transfer unit 5, a memory removing unit 51, and an insulation member 52 are arranged in turn around the photosensitive drum 1 in the rotating direction of the photosensitive drum 1 as indicated by the arrow A in FIG. 1.

The photosensitive drum 1, charger 2, memory removing member 51, and insulation member 52 are assembled as a single unit which is referred to as a drum unit and designated at 10. A shaft 1*a* of the photosensitive drum 1 of the drum unit 10 removably engages the developer unit 4.

The process unit 9 is arranged so as to be independently removable from the main body frame 21. The drum unit 10 and developer unit 4 are arranged such that they can be either integrally removed and lifted out of the main body frame 21 or such that only the drum unit 10 is removed.

As thus constructed, paper can be easily removed when a paper jam occurs within the process unit 9.

A user unit 6 which fuses a transferred toner image onto paper is arranged downstream of the drum unit 10. The fuser unit 6 includes a heating roller 61 and a pressing roller 62 which exert pressing force against each other.

A recording sheet supply and transport system 7, which includes a plurality of paper feed rollers 71, 72, 72', pick-up rollers 73, 73', and paper cassettes 74, 74', is arranged upstream of the drum unit 10.

The charger 2 is a brush roller type mechanism the roller surface of which is covered by electrically conductive fibers. A bias voltage is applied to the charger 2 such that the charger 2 uniformly charges the surface of the photosensitive drum 1 to roughly −750 V while it is rotating. The transfer unit 5 is formed of an electrically conductive foam material made of urethane resin or the like. A bias voltage (of between, for example, 500 V to 2 kV) of fixed current is applied to the transfer unit 5.

The developer unit 4 includes a developer main body 41 which houses toner 40, a toner supply roller 42 arranged in the lower portion of the developer main body 41, a developer roller 43 which is arranged between the supply roller 42 and the photo-sensitive drum 1 such that it rotates in contact with the roller 42 and drum 1, an agitator 44 which is located in the developer main body 41 to agitate the toner 40 stored in the developer main body 41, and a regulating blade 45 which contacts the surface of the developing roller 43 with spring-like resistant force at an upstream position in terms of the toner transfer direction, regulating the thickness of the toner layer on the roller 43.

The developing roller 43 may be formed of rubber or the like. It rotates around a shaft 43*a* formed of metal such as stainless steel, rotating in the direction of the B arrow in FIG. 2. The developing roller 43 may be charged with a bias voltage of, for example, about −300 V.

The regulating blade 45 may be formed of a metal such as stainless steel with some elasticity. The blade 45 may be charged with a bias voltage of, for example, about −650 V.

The supply roller 42 may be formed of foam urethane or the like. It rotates around a shaft 42*a* formed of metal such as stainless steel, rotating in the direction of the C arrow in FIG. 2. The supply roller 42 may be charged with a bias voltage of, for example, about −650 V.

The distance separating the axes of the supply roller 42 and the developer roller 43 is made slightly less than the sum of the radiuses of these rollers so that these two rollers exert force against each other at their contact area. A frictional relationship is caused between the rollers 42, 43 by this press contact therebetween and rotations of these rollers 42, 43 in the respective directions of the B and C arrows. This frictional relationship together with the bias voltages applied to these rollers 42, 43 causes the toner 40 to be charged in the vicinity of these rollers 42, 43.

The rotation of the supply roller 42 in the direction of arrow C causes the toner 40 which is filled into air pockets in the roller 42 to be transported to the developing roller 43. At the point of pressured contact between the supply roller 42 and the developing roller 43, the difference in electric potential between the rollers 42, 43 causes the toner 40 to adhere to the surface of the developing roller 43.

Rotation of the developing roller 43 in the direction of the B arrow then causes the toner 40 adhered onto the surface of the developing roller 43 to be transported towards the photosensitive drum 1. En route, the regulating blade 45, which has been charged to, for example, −650 V, makes the toner 40 adhered on the surface of the developing roller 43 into a layer of uniform thickness.

The image forming process in the image recording device 8 as just described will now be briefly described.

The photosensitive drum 1 rotates in the direction of the A arrow, and the charger 2, which is comprised as an electrically conductive fiber brush, uniformly charges the outer surface of the photosensitive drum 1 to about −750 V.

Next, based on image data, the photo transcribing unit 3 radiates light onto the surface of the photosensitive drum 1. Since the photosensitive drum 1 is a grounded photoconductive member, points at which the light strikes (in other words, points that correspond to black in the image data) are thereby charged to an electric potential of about −30 V, creating a voltage difference between points where the light strikes and points where the light does not (or in other words, between areas where the image data is black and areas where the image data is white). This results in an electrostatic latent image corresponding to the image data on the surface of the photosensitive drum 1 downstream of the transcribing unit 3.

The electrostatic latent image is brought to the developing unit 4. When the toner 40 which is adhered to the surface of the developing roller 43, and which has been charged to roughly −650 V, contacts the electrostatic latent image, it is drawn by the voltage difference between itself and the illuminated area on the surface of the drum 1, thereby forming a toner image on the drum surface.

This toner image is transported via the rotation of the photosensitive drum 1 to the area where the rotating photosensitive drum 1 and the transfer unit 5 contact. At the same time, recording paper is transported to the photosensitive drum-transfer unit contact area one sheet at a time from the supply cassettes 74 (74') by the pickup roller 73 as guided past the transport rollers 72 (72') and 71.

By applying a bias voltage of between 0.5 kV and 2 kV to the transfer unit 5, the toner image on the photosensitive drum 1 is attracted by the transfer unit 5, and then transferred and adhered onto the recording sheet. The recording sheet onto which the toner image has been transferred is then transported to the fuser unit 6 by the rotation of the photosensitive drum 1 and the transfer unit 5.

At the fuser unit 6, the recording sheet is guided into the pressure contact area between the heating roller 61 and the pressing roller 62. There, the resin elements incorporated in the toner 40 are fused by the heating and pressing action of the rollers 61, 62, forming a permanent, fused image on the paper. The paper is then discharged from the device. After the toner image has been transferred, the transfer unit 5 brings the surface of the drum 1 to 0 V with a small amount of untransferred toner being left.

The photosensitive drum 1 continues to rotate after this operation, and its surface is once again uniformly charged by the charger 2 before repeating the same process.

Voltage is applied to the memory erasing member 51, and the operation of the member 51 causes the untransferred toner remaining on the surface of the photosensitive drum to be scattered and spread over the surface of the drum 1, and to become charged.

Since the insulating member 52 is arranged between the memory erasing member 51 and the charging device 2, even if the erasing member 51 and the charging mechanism 2 are placed in close proximity to each other, there is no interference with image formation. Further, since the toner remaining on the surface of the photosensitive drum 1 is dispersed, it does not interfere with light emitted from the photo-transcribing unit 3, and image quality is not affected. The dispersed toner is carried to the developer unit 4, and drawn into the developer main body 41 by the electric potential difference between the toner 40 and the developing roller 43, and stored therein.

Regular rotation of the agitator 44 agitates the toner 40 inside the developer main body 41. Presence of any toner 40 remaining inside the developer main body 41 is also detected by a remaining toner detection member 56.

The remaining toner detection mechanism inside the developer unit 4 will now be described using FIG. 2 to FIG. 6. The agitator 44 is arranged inside the developer main body 41. The agitator 44 rotates in the direction of the D arrow in FIG. 2 around a rotary shaft 44*a*. The rotary shaft 44*a* is provided with a sheet-shaped agitator 46, which extends roughly the whole length of the shaft 44*a*. The agitator sheet 46 is, for example, arranged 90° upstream of a scraper 57 (hereinafter described) relative to the rotary direction of the agitator 44.

Thus, by rotating the agitator 44, the toner 40 stored inside the developer main body 41 is continuously stirred by the agitator sheet 46.

Two sheet-shaped members 54, 55 are arranged in the agitator 44, and the scrapper 57 is established by these member 54, 55.

The sheet-shaped members 54, 55 may be formed of a bendable material such as synthetic rubber. They extend from the rotary shaft 44*a* in a radially outward direction of the rotary shaft 44*a* and defines a planar surface parallel to the rotary shaft 44*a*.

The sheet-shaped member 54 is arranged downstream of the sheet shaped member 55 relative to the direction of rotation, and is layered on top of the sheet-shaped member 55.

The sheet-shaped member 55 is slightly wider along the axis of rotation of rotary shaft 44*a* than the sheet shaped member 54. The sheet-shaped members 54, 55 are fixedly attached at the middle portion of the rotary shaft 54*a* by a fastener 44*b*. Furthermore, the side portions 54*a*, 55*a* of the respective sheet shaped members 54, 55 are not fixedly attached to each other, but are separable.

The remaining toner detection member 56 is arranged on the lower side wall of the developer main body 41, and a recess 56*a* is formed in a concentric arc around the rotary path of the agitator 44 inside the remaining toner detection member 56. Both side walls 56*b* of the recess 56*a* are formed from a transparent material.

Figure 5:
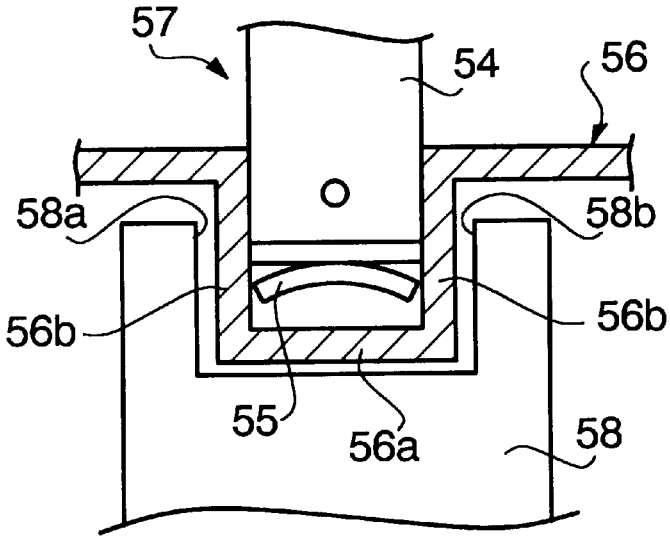
FIG. 5 is a cross-section view showing the relationship between the recess and the scraper.
Figure 6:
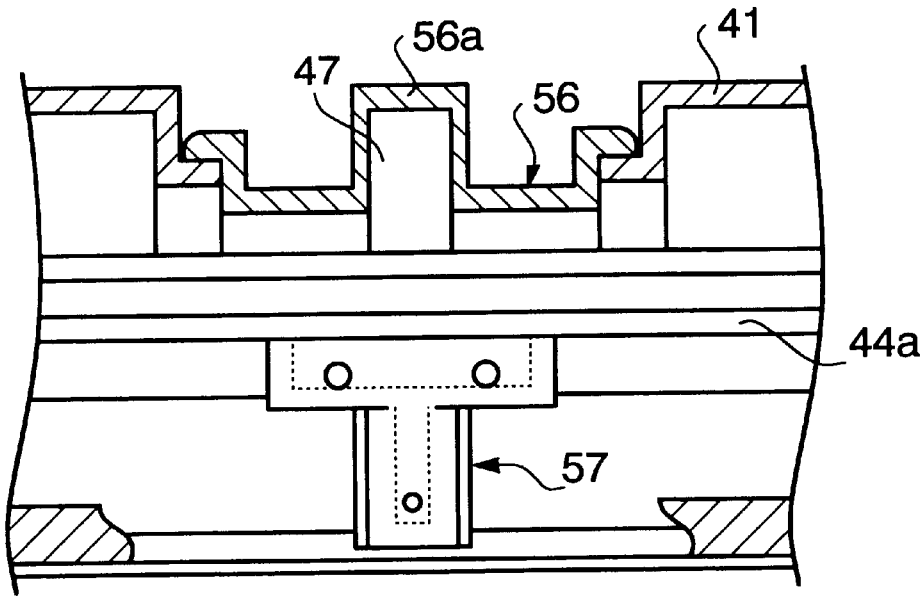
FIG. 6 is a plan view showing the supply member attached to the agitator.

The recess 56*a* is arranged so as to align with the scraper 57 such that, as shown in FIG. 5, the scraper 57 can engage in the recess 56*a*.

The sheet-shaped member 54 has a width (measured in the axial direction of the shaft 44*a*) substantially the same as the width of the recess 56*a* so that the side sections 54*a* of the sheet-shaped member 54 slide in contact with the inner side walls 56*b* of the recess section 56*a*.

The other sheet-like member 55 is slightly wider than the recess 56*a*. The sides 55*a* of this sheet member 55 bend rearward in the direction of rotation as they slide in contact with the side walls 56*b* of the recess 56. The sheet member 55 therefore applies greater pressure to the recess's side walls 56*b* than the sheet member 54 when these two sheet members 54, 55 simultaneously move in the recess 56*a*.

A light emitting unit 58*a* of a photo sensor 58 is arranged near an outer surface of one of the side walls 56*b* of the recess 56*a*, and a light-receptor unit 58*b* is arranged near an outer surface of the other side wall 56*b*. Light emitted from the photo emitting unit 58*a* passes through both side walls 56*b* of the recess 56*a*, and is received by the photo-receptor unit 58*b*. This enables the presence of the toner 40 to be detected.

The remaining toner detection mechanism is designed such that if light is continuously received by the photoreceptor 56*b* for longer than a predetermined interval, then it is determined that there is no toner, while if the interval during which light is received by the photoreceptor is shorter than the predetermined interval, it is determined that toner is present.

The presence of toner 40 is detected by the remaining toner detection means comprised as described above in the following manner.

The scraper 57 rotates integrally with the agitator 44 inside the developer main body 41, passing through the recess 56*a* at regular intervals. If, for example, there is toner inside the developer main body 41, then toner which has been thrust into the recess 56*a* is scooped out.

The toner 40 which adheres to the side walls 56*b* of the recess 56*a* is removed when the sides 54*a*, 55*a* of the sheet-shaped members 54, 55, which exert pressure against the side walls 56*b* of the recess 56*a*, slide through the inside of the recess 56*a*, thus cleaning the side walls 56*b* of the recess 56*a*.

When there is toner 40 stored inside the developer main body 41, the scraper 57 cleans the side walls 56*b*, and then the agitated toner 40 is again advanced into the recess 56*a*. Thus, the light emitted from the photo emission unit 58*a* is received by the photo-receptor unit 58*a* during the interval from when the scraper 57 passes through the recess 56*a* until the toner 40 is once again advanced inside the recess by the supply member 47, but is obstructed by the toner 40 and does not reach the photo receptor 58*b* once the toner 40 is advanced into the recess 56*a*.

The predetermined interval needed to detect an absence of toner is set longer than the interval between the time when the scrapper 57 passes the photo emission unit 58*a* and the time when the supply member 47 passes the photo emission unit 58*a*. Consequently, if light does not arrive at the photo receptor 58*b* during this interval, the remaining toner detection mechanism determines that toner is present.

On the other hand, when the toner 40 is not stored in the developer main body 41, the toner 40 may be adhered to the side walls 56*b* of the recess 56 before cleaning is performed by the scraper 57, and the light emitted from the photo emission unit 58*a* of the photo sensor 58 may not be received by the photoreceptor unit 58*b*.

In this case, when the scraper 57 then passes through the inside of the recess 57, the toner adhered to the inner walls 56*b* is removed by the sheet-shaped members 54, 55, and no new toner is advanced into the recess 56*a*.

Since even if all of the toner 40 adhered to the inner surface of the walls 56*b* is not removed by the forwardly arranged sheet-shaped member 54, the toner can be reliably and completely removed by the other sheet-shaped member 55, which is arranged after the sheet-shaped member 54 in the direction of rotation.

As a result, the light from the photo emission unit 58*a* is continuously received by the photo-reception unit 58*b* over the predetermined interval, causing the remaining toner detection mechanism to determine that there is no toner remaining.

The remaining toner detection mechanism of the present embodiment detects the presence of toner 40 remaining inside the developer main body 41 in the above described manner. When there is a small amount of toner 40 remaining, however, the agitating operation of only the agitator 46 may not be sufficient to advance the toner 40 inside the recess 56*a* after the recess 56*a* is cleaned by the scraper 57. This may lead to faulty determination that no toner is left, in spite of a fact that there is actually toner remaining in the developer main body 41.

The image recording apparatus 8 is thus provided with the supply member 47 for supplying the toner 40 that remains in the developer main body 41 into the recess 56*a* of remaining toner detection unit 56. The supply member 47 is coupled to the rotary shaft 44*a* of the agitator 44 such that the toner 40 is forcibly advanced into the recess 56*a* with the rotary movement of the agitator 44.

The supply member 47 is formed as a thin sheet of polyethylene terephtalate resin (PET), thus forming a flexible member. This supply member 47 projects outward from the rotary shaft 44*a* in the radius direction of the shaft 44*a*, and is arranged such that its flat surface runs parallel to the shaft 44*a*. Its width along the axis of rotary shaft 44*a* is roughly equivalent to the width of recess 56*a*. The supply member 47 is arranged to be separated by a 90° angle downstream from the scraper 57 relative to the direction of rotation of the agitator 44.

Figure 7:
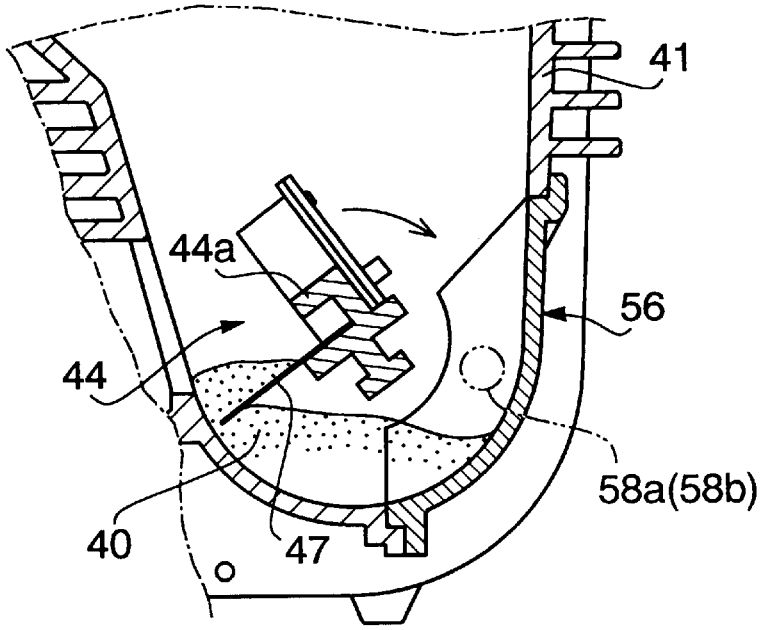
FIG. 7 is a partial side cross sectional view of the developer main body with the toner being scooped up by the supply member.

The supply member 47 is attached to the agitator 44 and rotates integrally as the agitator 44 rotates. Thus, as shown in FIG. 7, the toner 40 can be scooped up by the supply member 47 even when only a small amount of toner 41 remains in the developer main body 41.

Figure 8:
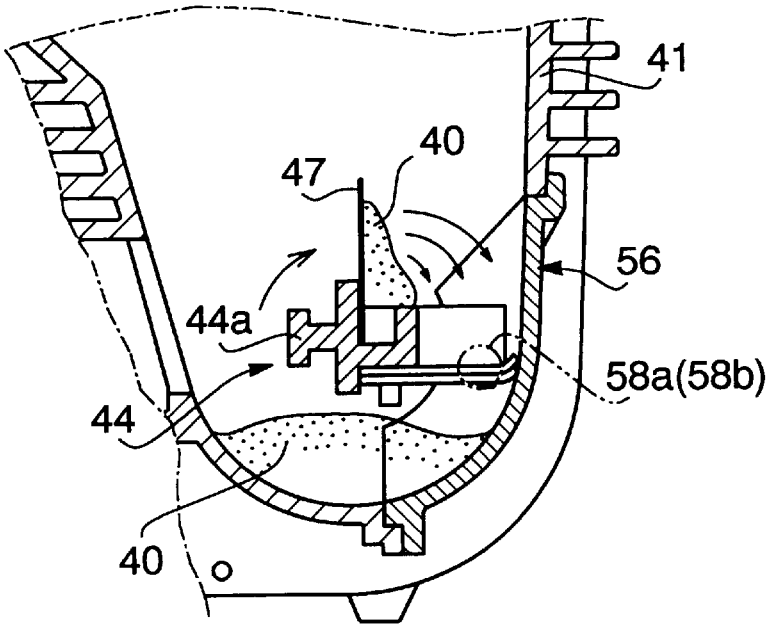
FIG. 8 is a view similar to FIG. 7 with the toner being supplied to the recess by the supply member.

As illustrated in FIG. 8, the scraper 57 passes through and cleans the portion of the recess 56*a* with which the photo emitter 58*a* and the photo receptor 58*b* are associated, after which the toner 40 scooped up by the supply member 47 is redeposited into the recess 56*a*.

Figure 9:
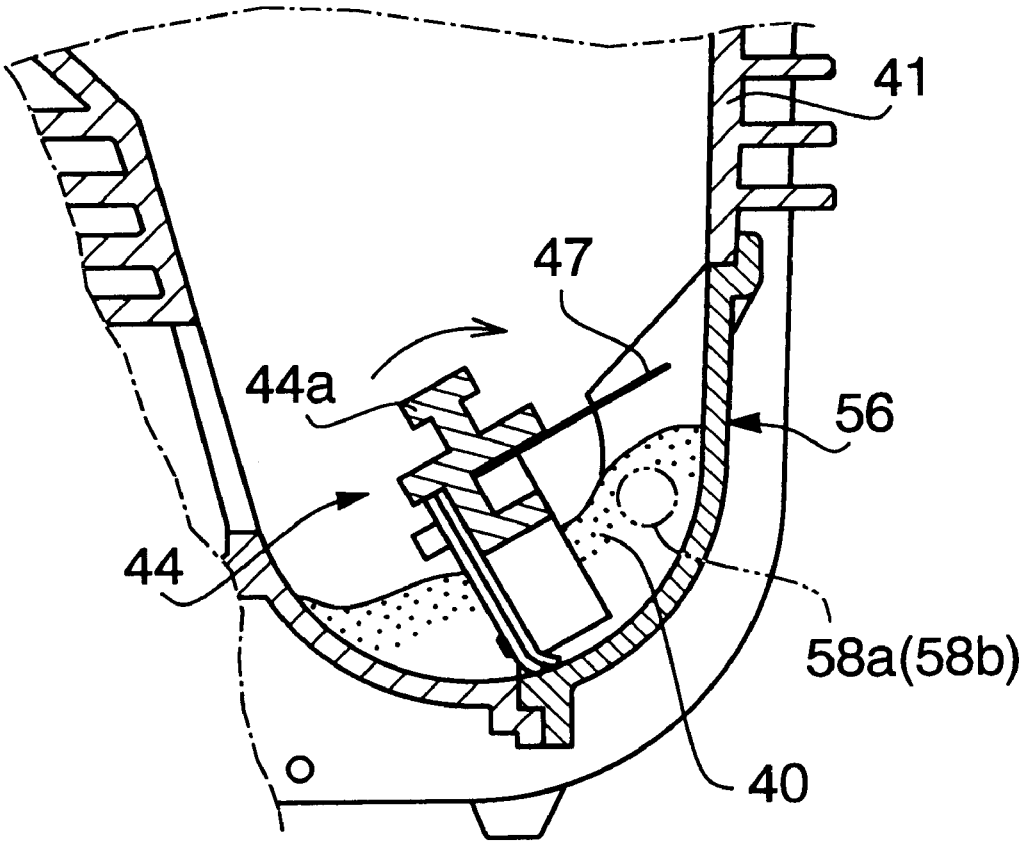
FIG. 9 is a view similar to FIG. 7 when the toner has been supplied into the recess by the supply member.

Thus, as shown in FIG. 9, the toner 40 is supplied and advanced into the area of the recess 56*a* with which the photo emitter 58*a* and the photo receptor 58*b* are associated.

This composition allows the toner status to be accurately detected even when there is only a small amount of toner 40 remaining in the developer main body 41 and prevents erroneous toner status detection. As described above, this is accomplished by using the supply member 47 arranged downstream of the scraper 57 to supply the toner 40 into the area of the recess 56*a* through which the photo emitter 58*a* emits light towards the photo receptor 58*b*. After the recess 56 is cleaned, the toner 40 scooped into the recess 56*a* by the supply member 47 obstructs the light emitted from the photo emitter 58*a* of the photo sensor 58.

Since the supply member 47 is arranged at a roughly 90° angle downstream from the scraper 57 relative to the direction of rotation of the agitator 44, the toner 44 existing in the developing main body 41 regardless of its amount can be reliably supplied into the recess 56a after the scraper 57 has cleaned it out. This further enables the status of the toner 40 to be reliably detected.

Since the supply member 47 is flexible, it bends due to the weight of the toner 40 if a large (or relatively large) amount of toner 40 remains. This reduces the stress to the toner 40 and therefore prevents deterioration of the toner. If the supply member were rigid, the toner would easily be degraded by friction between the toner particles, and the stress applied to the toner. In particular, the toner deterioration would be promoted if a large amount of toner were agitated by the solid member.

Therefore, the supply member 47 is able to reliably supply the toner into the recess 56 regardless of the amount of toner remaining.

This application claims priority of Japanese Patent Application No. 10-122253 filed May 1, 1998 with JPO and the entire disclosure thereof is incorporated herein by reference.

What is claimed is:

1. An image recording apparatus comprising:

a developer unit having a main body for storing toner therein;

a remaining toner detection unit arranged inside the developer main body;

a scraper which cleans the remaining toner detection unit while being rotated; and a supply member rotatable together with the scraper and arranged downstream of the scraper relative to their direction of rotation for supilying stored toner to the remaining toner detection unit, where the remaining toner detection unit has a recess and the scraper cleans the recess, and the scraper includes first and second sheet members, both the first and second sheet members are made from a flexible material, a width of the first sheet member is substantially equal to a width of the recess, and a width of the second sheet member is slightly larger than the width of the recess.

2. The image recording apparatus according to claim 1, wherein the supply member is arranged at roughly a 90° angle downstream of the scraper relative to the their direction of rotation.

3. The image recording apparatus according to claim 2, wherein the supply member is formed as a flexible member.

4. The image recording apparatus according to claim 1, wherein the supply member is formed as a flexible member.

5. The image recording apparatus according to claim 1, wherein the remaining toner detection unit has a recess, and a light emitting device and a light receiving device provided across the recess, the light emitting device adapted to emit light towards the light receiving device through the recess so that if toner is present in the recess, the light from the light emitting device does not reach the light receiving device.

6. The image recording apparatus according to claim 1 further including an agitator element rotatable together with the scraper and arranged upstream of the scraper relative to their direction of rotation for agitating the toner in the developer main body.

* * * * *